US005274964A

United States Patent [19]

Simpson et al.

[11] Patent Number: 5,274,964

[45] Date of Patent: Jan. 4, 1994

[54] DRY ABRASIVE BELT CLEANER

[75] Inventors: Steven C. Simpson, Overland Park, Kans.; Ronald O. Cowell, Independence, Mo.; David W. Schroeder, Blue Springs, Mo.

[73] Assignee: Abrasive Cleaning Systems, Inc., Overland Park, Kans.

[21] Appl. No.: 932,366

[22] Filed: Aug. 19, 1992

[51] Int. Cl.[5] ..... B24C 3/04

[52] U.S. Cl. ..... 51/417; 51/420; 51/426; 51/319; 51/262 A

[58] Field of Search ..... 51/417, 418, 419, 420, 51/426, 415, 416, 216, 66, 324, 319, 262

[56] References Cited

U.S. PATENT DOCUMENTS

| | | | |
|---|---|---|---|
| 1,413,060 | 4/1922 | Roberts | 51/325 |
| 1,939,383 | 12/1933 | Bradley et al. . | |
| 2,281,344 | 4/1942 | White . | |
| 2,516,222 | 7/1950 | Lindmark | 51/419 |
| 2,565,341 | 8/1951 | Arispe | 51/15 |
| 2,568,096 | 9/1951 | Stewart | 15/316.1 |
| 2,590,819 | 3/1952 | Huyett | 51/419 |
| 2,669,810 | 2/1954 | Carlson et al. | 51/416 |
| 2,719,529 | 10/1955 | Wells | 134/144 |
| 2,910,812 | 11/1959 | Brunner | 51/320 |
| 3,177,627 | 4/1965 | Guibert et al. | 51/262 A |
| 3,436,866 | 4/1969 | Nye | 51/416 |
| 3,812,622 | 5/1974 | Parsons | 51/325 |
| 4,109,422 | 8/1978 | Parsons | 51/325 |
| 4,150,512 | 4/1979 | Novak | 51/262 A |
| 4,293,970 | 10/1981 | Bencene et al. | 15/21 D |
| 4,525,955 | 7/1985 | Cothrell et al. | 51/135 R |
| 5,168,671 | 12/1992 | Kataoka et al. | 51/325 |

FOREIGN PATENT DOCUMENTS

| | | | |
|---|---|---|---|
| 2067935 | 8/1981 | United Kingdom | 51/319 |

*Primary Examiner*—Robert A. Rose

*Attorney, Agent, or Firm*—Hovey, Williams, Timmons & Collins

[57] ABSTRACT

Apparatus (10) is provided for cleaning of dirty, clogged sandpaper, particularly large, industrial size sandpaper belts (190) used in furniture making operations. The apparatus (10) includes a drum (58) adapted to support a belt (190), together with blasting means (16) adjacent the drum (58) for creating a stream of particulates directed toward a portion of the belt (190) for cleaning purposes. Positioning means (18) is also provided for selectively changing the relative orientation of the blasting means (16) and the belt (190) in order successively clean different portions of the belt (190). Preferably, a laterally reciprocal nozzle (108) is employed for creating the particulate stream, and the belt (190) is intermittently shifted via a pneumatic mechanism (158) to present successive portions of the belt (190) for cleaning thereof. Dislodged material and dust is conveyed from the apparatus (10) through a port (42), whereas the particulate cleaning media is collected in a lower hopper (50) for recirculation to the nozzle (108).

24 Claims, 4 Drawing Sheets

DRY ABRASIVE BELT CLEANER

BACKGROUND OF THE INVENTION

1. Field of the Invention

The present invention is broadly concerned with an apparatus for cleaning of sandpaper, and a corresponding method, which finds particular utility in the context of furniture making operations where large, industrial-sized sandpaper belts are frequently used. Broadly speaking, the apparatus of the invention includes means for supporting sandpaper in a cleaning position, together with blasting means for creating a stream of particulates directed toward the sanding surface of the paper in order dislodge accumulated sanding material; the apparatus further includes positioning means for selectively altering the relative spatial orientation of the blasting means and sanding surface, in order to direct the particulate stream toward different portions of the sanding surface.

2. Description of the Prior Art

Furniture makers employ large sanding machines for finishing wood surfaces. Typically, this equipment makes use of large endless-belt sandpaper, which may have either cloth or paper as a substrate with grit applied to the outer surface of the substrate. During sanding operations it frequently occurs that the sanding surfaces of the belts become clogged with sanded material or dust. This problem is particularly acute during the sanding of soft woods. It is well known that accumulation of dust detracts from the efficiency of the sandpaper to the point that, unless the belts are cleaned, they are effectively useless.

Cleaning of sandpaper belts has been attempted in the past, but only in the case of belts made from cloth substrates. Such prior techniques have generally involved a water rinse or washing of the belts, followed by drying. The washing procedures are only partially effective, and moreover complete drying of the belts can be difficult, particularly in humid weather. Moreover, these prior methods cannot be used with belts made using paper substrates, inasmuch as the paper will either be destroyed or distorted by contact with water.

There is accordingly a decided need in the art for an improved method and apparatus designed to effectively clean sandpaper of accumulated dust, and which is applicable both to cloth and paper-based sandpapers.

SUMMARY OF THE INVENTION

The present overcomes the problems outlined above, and provides an improved sandpaper cleaning apparatus which completely eliminates water treatment and instead relies upon a pneumatic technique for the physical dislodgement of accumulated dust. Broadly speaking, the apparatus of the invention includes means for supporting the outer or sanding surface of sandpaper in a cleaning position, along with blasting means (e.g., a high pressure nozzle) for creating a stream of particulates which are directed toward the sanding surface for dislodging sanding material therefrom. In addition, the overall apparatus includes positioning means for selectively altering the relative spatial orientation of the blasting means and supported sanding surface, in order to selectively direct the stream towards different portions of the sanding surface so that the entire surface may be quickly and completely cleaned.

In preferred forms, the apparatus of the invention is positioned within an enclosed housing, with the latter being equipped with a vacuum system for removal dislodged dust, as well as a lower hopper for accumulating the particulates used for cleaning purposes. The particulate hopper is connected via a conduit to the blasting nozzle for recirculation of accumulated particulates.

The preferred apparatus is particularly designed for handling and cleaning of large endless-belt sandpaper typically used in furniture making. To this end, the apparatus includes an elongated, horizontally disposed drum adapted to receive thereover a belt to be cleaned. The blasting nozzle is located adjacent the drum and is mounted for lateral movement between the margins of the sandpaper to be cleaned. Limit switches are employed for controlling the side-to side movement of the blasting nozzle. In order to clean the entire endless-belt sandpaper, apparatus is provided for incrementally rotating the belt-supporting drum so that fresh sections of sandpaper to be cleaned are intermittently presented to the blasting nozzle.

DETAILED DESCRIPTION OF THE PREFERRED EMBODIMENT

Figure 2:
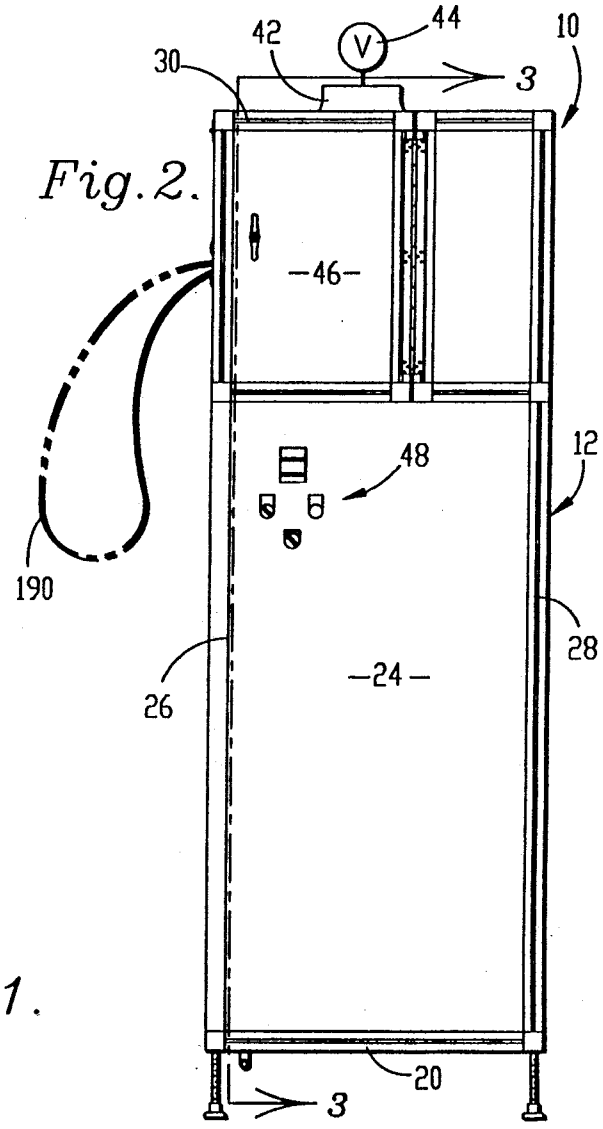
FIG. 2 is a side view of the apparatus illustrated in FIG. 1.
Figure 1:
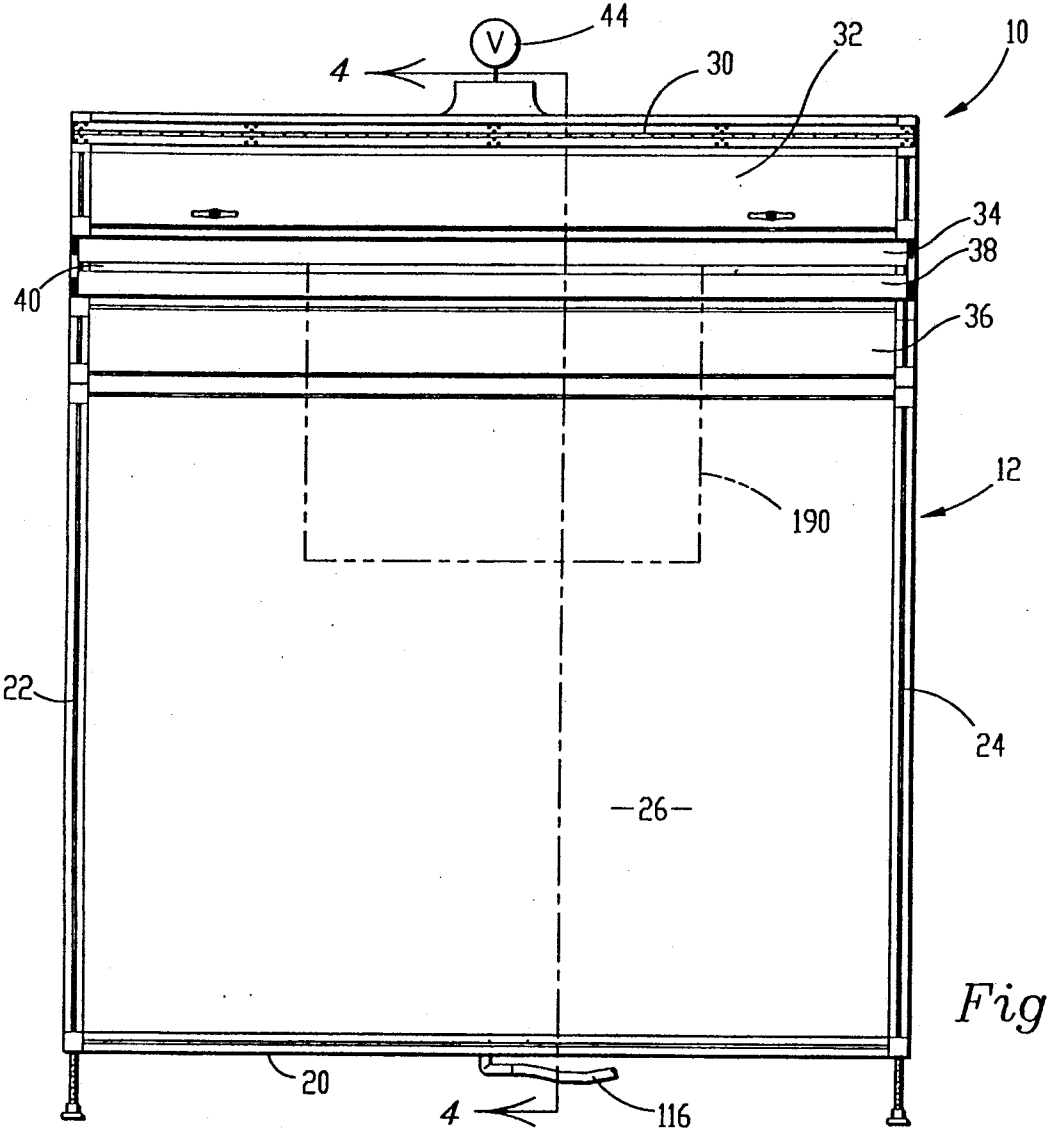
FIG. 1 is a front elevational view of the sandpaper cleaning apparatus of the invention, with an endless-belt sandpaper section to be cleaned illustrated in phantom.

Turning now to the drawings, and particularly FIGS. 1–5, sandpaper cleaning apparatus 10 in accordance with the invention broadly includes an external housing 12, a sandpaper-supporting assembly 14, blasting assembly 16, and positioning means broadly referred to by the numeral 18.

Figure 4:
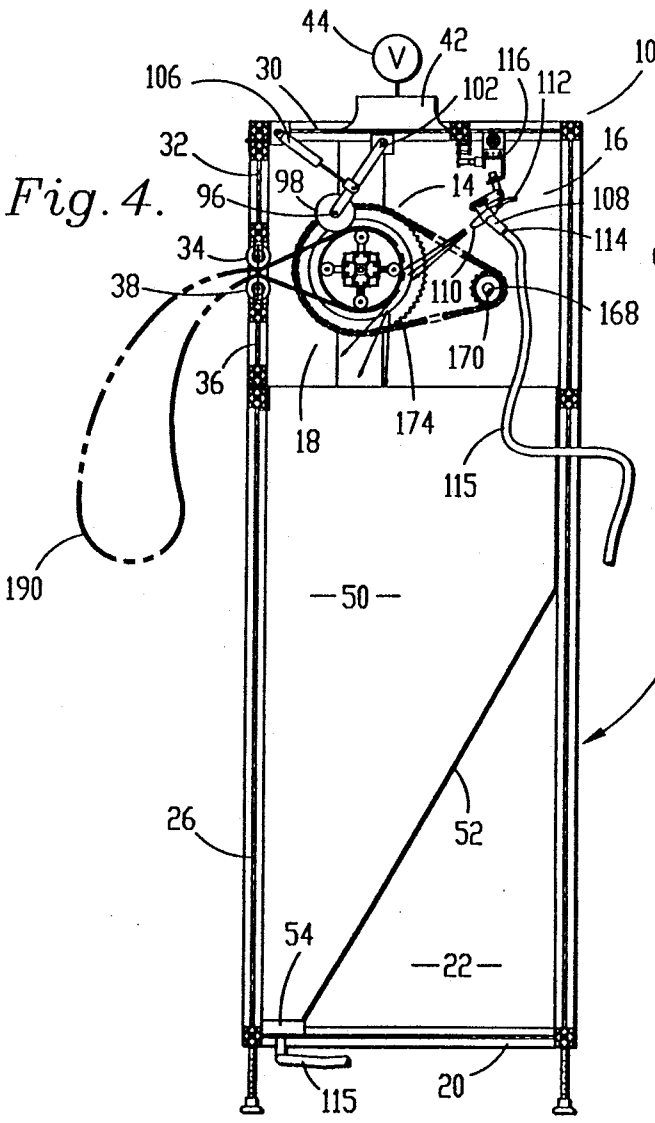
FIG. 4 is a vertical sectional view taken along line 4—4 of FIG. 1.

In more detail, the housing 12 is in the form of an upright cabinet presenting a bottom wall 20, a pair of spaced-apart sidewalls 22, 24, front and rear walls 26, 28, and top wall 30. Referring specifically to FIG. 4, it will be observed that the front wall 26 includes, adjacent the upper portion thereof, a hingedly connected upper door 32 having an elongated roller 34 affixed to the bottom margin thereof. Additionally, the front wall 26 has an upper panel section 36 adjacent door 32, with the panel section likewise having an elongated roller 38 at its upper margin. Accordingly, the two rollers 34, 38 cooperatively define a laterally extending entrance slit 40.

Top wall 30 includes a central port 42 which communicates with the interior of the housing 12. An exhaust conduit (not shown) is coupled to port 42, with the exhaust conduit being connected to a vacuum pump 44 or to an overall plant dust-collecting system, if available.

Sidewall 24 (see FIG. 2) includes a hingedly mounted access door 46 adjacent the upper end thereof which permits installation and removal of sandpaper in the manner to be described. In addition, conventional on-off and control switches 48 are mounted on sidewall 24 below door 46 as shown.

Figure 3:
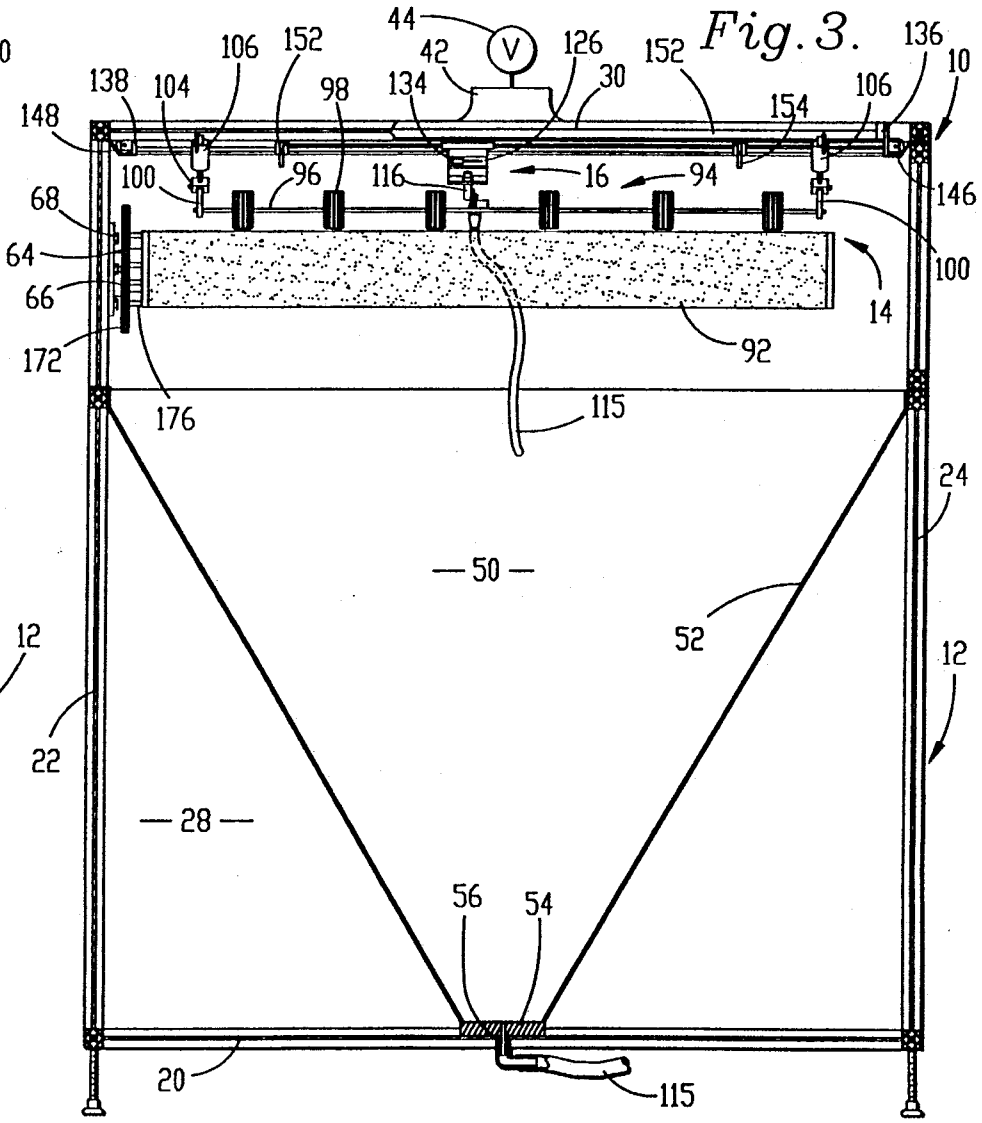
FIG. 3 is a vertical section view taken along line 3—3 of FIG. 2, and depicting the internal construction of the sandpaper cleaning apparatus.

The overall housing 12 includes internal wall sections which define a particulate accumulation hopper 50. Specifically, the hopper 50 is defined by front wall 26 beneath panel 36, as well as obliquely oriented, converging walls 52 and apertured bottom wall 54 secured to the bottom wall 20 of the housing 12. A tubular outlet fitting 56 extends through bottom walls 54 and 20 as best seen in FIG. 3.

Figure 6:
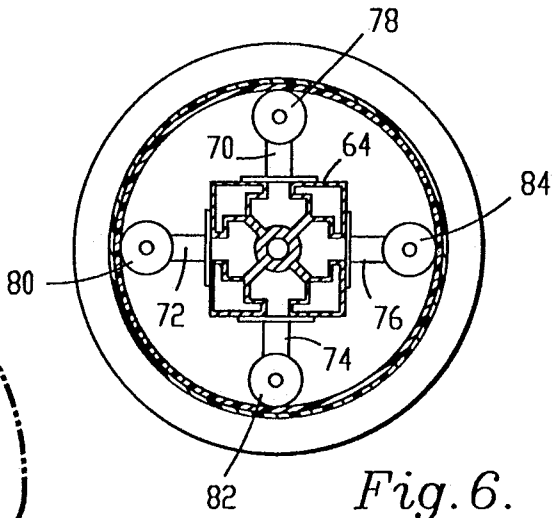
FIG. 6 is an enlarged vertical section view illustrating the internal construction of the sandpaper-supporting drum.

The sandpaper support assembly 14 includes an elongated drum 58 composed of ABS synthetic resin material. Drum 58 is cantilever-mounted for axial rotation thereof. In particular and referring specifically to FIGS. 3 and 6, it will be observed that the mounting assembly includes an elongate, laterally extending, stationery metallic box-like mount 64 which is secured to sidewall 22 by means of an endmost flange 66 and fasteners 68. The mount 64 includes a total of four circumferentially spaced, radially outward extending arms 70–76, each equipped with an outer most drum-engaging roller 78–84. As illustrated in FIGS. 4 and 6, the mounting assembly made up of the mount 64 and supported rollers 78–84 are positioned within the confines of drum 58, with the rollers engaging the drum and permitting axial rotation thereof relative to the internal mounting structure. Preferably, the outer surface of drum 58 is provided with a synthetic resin coating 92 to facilitate gripping of a sandpaper belt. In practice, LINATEX coating available from Linatex Corp. of America has been used to good effect.

The sandpaper supporting assembly 14 further includes a hold-down mechanism 94 positioned adjacent drum 58. The mechanism 94 includes an elongated shaft 96 which supports a total of six resilient, rotatable, sandpaper-engaging wheels 98 which are located closely adjacent the outer surface of drum 58. The shaft 96 is supported by a pair of endmost, upwardly extending links 100 which are pivotally secured via appropriate mounting blocks 102 to upper wall 30. In addition, the extensible arms 104 of a pair of pneumatic piston and cylinder assemblies 106 are respectively coupled to the respective links 100 in order to effect selective raising and lowering of the shaft 96 and rollers 98 relative to drum 58.

The blasting assembly 16 includes a high pressure pneumatic nozzle 108 equipped with an outlet 110 oriented for directing particulates towards drum 58. In addition, the nozzle 108 includes a positive air line 112 adapted to be connected with a source of positive pressure air. Finally, the nozzle has a particulate inlet 114 in communication with outlet 110 and line 112 for delivery of particulates to the nozzle. An elongated flexible conduit 115 is connected to particulate inlet 114 and passes through rear wall 28 for ultimate connection with outlet fitting 56.

The nozzle 108 is supported on a metallic bracket 116, the latter including a forwardly extending link 118 provided with a slot 120 therein. The nozzle 108 includes (see FIG. 7) an upstanding, apertured tang 122 which receives a connector 124 serving to secure the nozzle 108 to link 118. The rearmost upstanding segment of the bracket 116 is secured to a metallic carriage 126, which forms a part of the overall mechanism 128 operable for lateral, back and forth shifting of the carriage 126 and hence nozzle 108.

Figure 7:
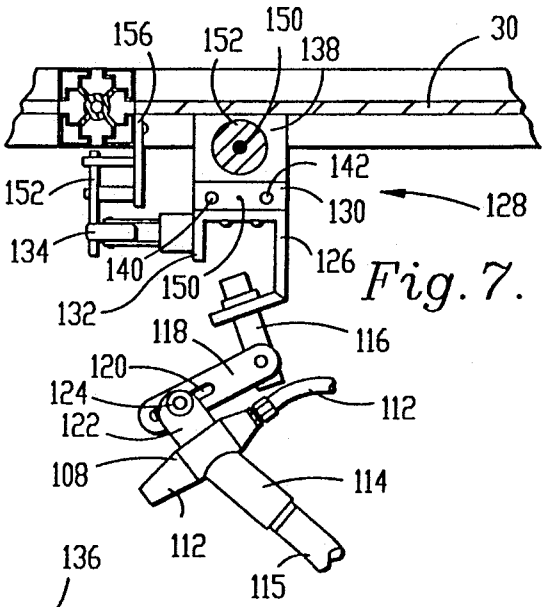
FIG. 7 is an enlarged, fragmentary vertical sectional view illustrating in detail the support arrangement for the shiftable nozzle of the sandpaper cleaning apparatus.
Figure 8:
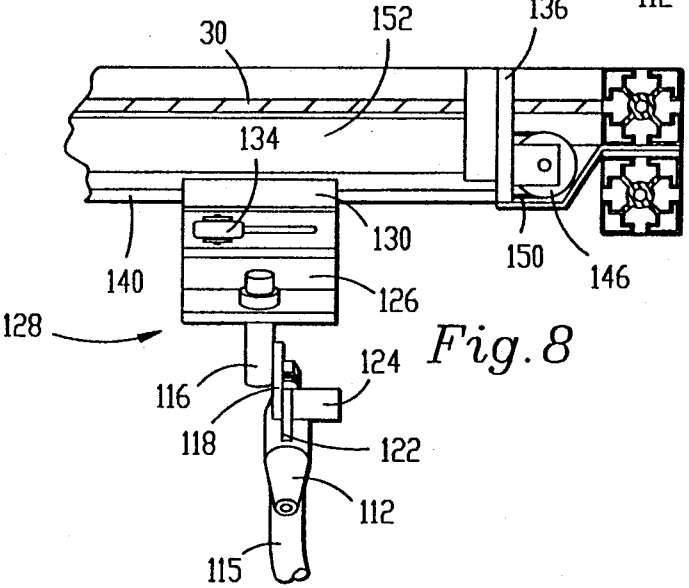
FIG. 8 is an enlarged, fragmentary front view illustrating the shifting mechanism associated with the nozzle.

The shifting mechanism 128 is a commercially available unit sold by Greenco as the "TRAC-TROL" cable cylinder assembly. Generally speaking, this unit includes a carriage 126 having an upper, apertured mounting block 130 as well as a depending wall 132 carrying a forwardly extending limit switch-engaging wheel 134. The overall mechanism 128 further includes a pair of end walls 136, 138, with a pair of rigid metallic rods 140, 142 extending between the end walls 136, 138. As best seen in FIGS. 7 and 8, the block 130 is apertured for slidably receiving the rods 140, 142, with the latter guiding the reciprocal shifting movement of the carriage 126.

Figure 9:
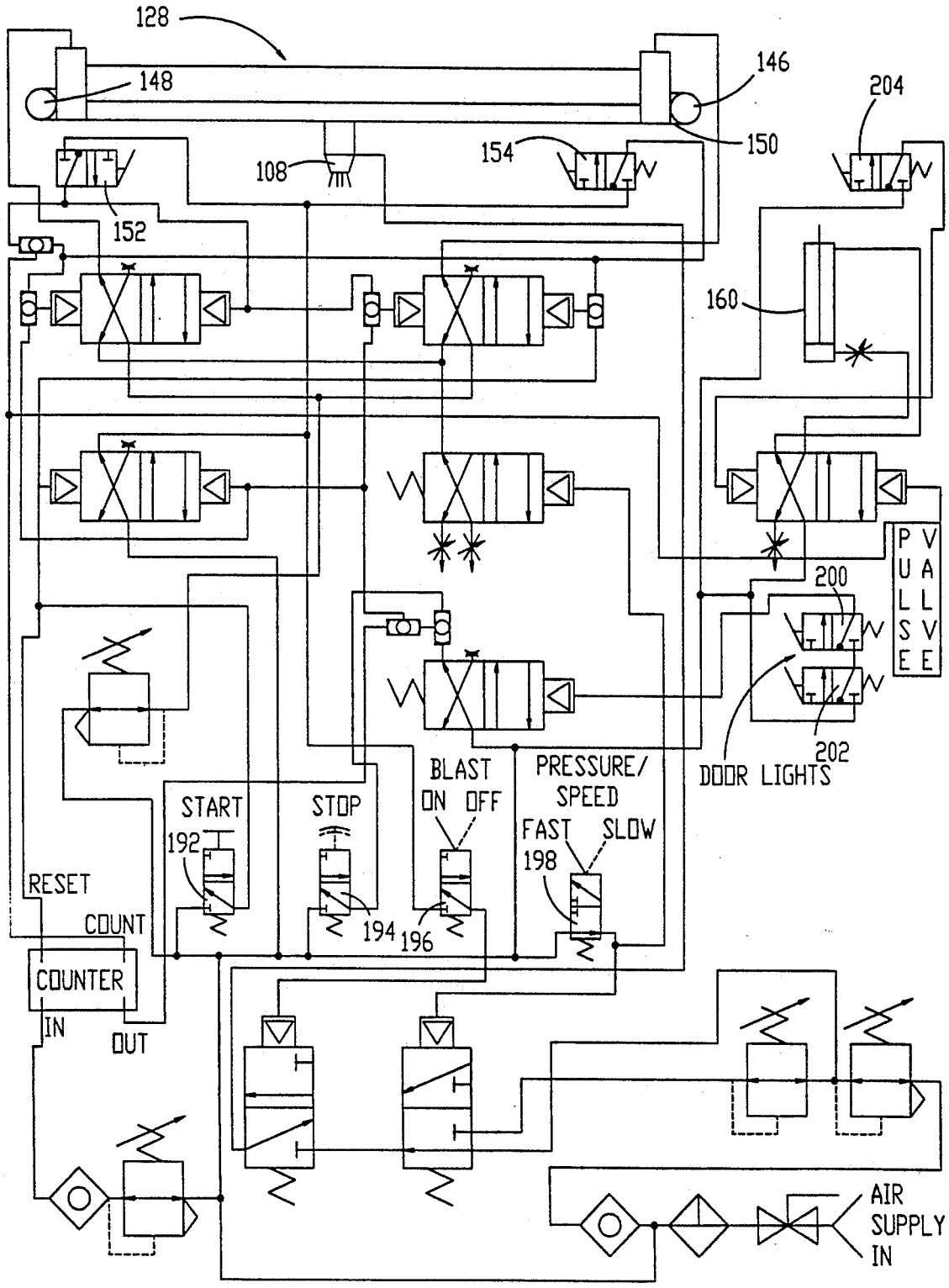
FIG. 9 is a schematic diagram of the pneumatic controls of the present invention.

Each of the end walls 136, 138 further supports a corresponding cable pulley 146, 148. A continuous, endless loop cable 150 is trained around the pulleys 146, 148, with the lower stretch thereof connected to block 130 of carriage 126 as illustrated in FIG. 7. It will be appreciated that rotation of the pulleys 146, 146 effects shifting of the cable 150, so as to selectively move carriage 126. Such movement is guided in part by means of an elongated tube 1152 situated above the carriage 126 and receiving the upper stretch of cable 150. The Trac-Trol unit is selectively operated to effect shifting of the nozzle 108 by conventional pneumatic controls coupled with the overall pneumatic system for the apparatus 10 as illustrated in FIG. 9.

A pair of spaced apart limit switches 152, 154 are secured adjacent upper wall 30 by means of mounting brackets 156 connected to housing 12 (see FIG. 7). The limit switches 152, 154 form a part of the control system for apparatus 10, and are oriented for engagement by the wheel 134 carried by carriage 126. It will therefore be seen that the limit switches control the length of lateral travel of the nozzle 108 within apparatus 10 between end walls 136, 138.

Shifting mechanism 128 may also be mounted above top wall 30 with carriage 126 extending downwardly through an elongated slot defined in wall 30 with the components associated with nozzle 108 suspended therefrom within the interior of housing 12. The slot is sealed with two abutting elongated resilient strips with carriage 126 moving between these two strips. With this configuration, the most delicate components of mechanism 128 are located exterior of housing 12 and are not exposed to blasting particulates and dust.

Figure 5:
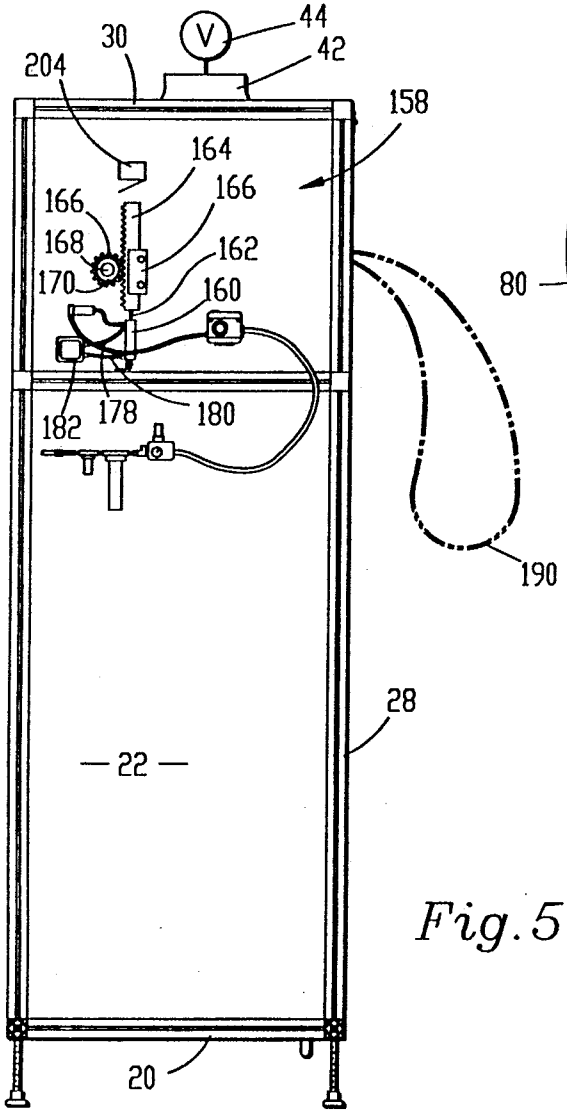
FIG. 5 is a side elevational view of the sandpaper cleaning apparatus opposite that illustrated that in FIG. 2, and further depicting the apparatus for incremental shifting of the sandpaper-supporting drum.

The positioning means 18 also includes structure broadly referred to by the numeral 158 for intermittent shifting of a sandpaper belt within apparatus 10 in order to successively present different portions of the belt for cleaning by nozzle 108. The apparatus 158 is illustrated in FIG. 5 and includes a pneumatic piston and cylinder assembly 160 secured to the outer surface of sidewall 22 in an upright orientation with piston rod 162 uppermost. A toothed rack 164 is affixed to the upper end of rod 162, and is received within a guide 166 to facilitate up and down movement of the rack 164. A pinion gear 166 is mounted adjacent rack 164 and is meshed with the latter. The pinion 166 is in turn supported on a transverse shaft 168 which extends through sidewall 22. A one-way clutch 170 of conventional construction serves to interconnect shaft 168 and pinion 166, so as to transmit torque to the shaft 168 only upon counterclockwise rotation of pinion 166 as viewed in FIG. 5, i.e., only upon upward shifting of rack 164.

The inner end of shaft 168 is keyed to a small drive gear 170 located adjacent the inner surface of sidewall 22 (see FIG. 4). The gear 170 is connected to a large drum gear 172 by means of roller chain 174. The drum gear 172 is of annular construction and is situated adjacent the inner surface of sidewall 22 in surrounding relationship to the stationary beam mount 64. A series of connectors 176 are employed for coupling the gear 172 with flange 60 of drum 58.

Again referring to FIG. 5, it will be seen that the piston and cylinder assembly 160 is of the double-acting variety and is equipped with a pair of pneumatic lines 178, 180 respectively coupled with the opposed ends of the cylinder. These lines are in turn connected with a regulator 182.

In the use of apparatus 10, an endless sanding belt 190 is first positioned within housing 12 over drum 58. This is accomplished by first opening doors 32 and 46, in order to elevate the rollers 98 away from drum 58. At this point the clogged belt 190 is shifted laterally and positioned over drum 58 with a substantial portion of the belt extending outwardly from housing 112. The doors 32, 46 are then closed, so that the forwardly extending portion of the belt 190 passes through the entrance slit 40 defined between the rollers 34, 38. Furthermore, closing of door 34 serves to lower the rollers 96 into contact with the outer surface of belt 190 at the region of drum 58. In preferred usage, it is also helpful to place a length of one and one-quarter inch pipe in the exposed loop of belt 190 as a weight to help maintain tension on the belt.

The blasting assembly 16 is next actuated in order to simultaneously shift nozzle 108 laterally while creating a stream of particulates derived from hopper 50 and directed against the adjacent surface of the belt 190. Of course, such lateral shifting of the nozzle 108 is accomplished by appropriate action of the mechanism 128, and a sufficient number of back-and-forth passes of the nozzle 108 are used to completely clean the adjacent portion of the belt 190.

When this initial portion has been adequately cleaned, the belt-shifting structure 158 comes into play in order to incrementally shift the belt 190 within housing 12 so as to present the next section of the belt for cleaning. Specifically, the rack 164 is shifted upwardly via piston and cylinder 160, so that the pinion 166 is correspondingly rotated in a counterclockwise direction. This has the effect of rotating gear 170 and thus, through the medium of roller chain 174 and drum gear 172, also rotating the drum 58. Inasmuch as the drum 58 has an external non-slip coating, this rotation moves the belt 190 in an incremental fashion and clockwise as viewed in FIG. 4. At this point the nozzle 108, shifted through mechanism 128, serves to clean the newly presented portion of the belt 190. When the piston and cylinder 160 reaches the upper end of its stroke, it is retracted back to its lowered starting position. Such lowering is accomplished without rotation of shaft 168, by virtue of the one-way clutch 170 interposed between pinion 166 and shaft 168.

Operation of apparatus 10 thus proceeds until the entire belt 190 is cleaned, at which point the belt may be removed by opening the doors 32, 46 and sliding the cleaned belt off of drum 58; the next dirty belt is then installed in its place. During belt cleaning, the accumulated material and dust removed from the belt 190 is conveyed from housing 12 through port 42 for disposal. As described previously, the port 42 may be conveniently connected with a standard dust collection system commonly found in furniture making plants. In addition, the heavier particulate materia used for cleaning purposes drops by gravity into hopper 50 where it is collected for reuse. As the hopper 50 fills with particulates, these are conveyed through conduit 115 back to the inlet 114 of nozzle 108.

FIG. 9 is a schematic illustration of the pneumatic controls for apparatus 10 using conventional pneumatic control devices shown in standard pneumatic notation. In addition to the components already called out, the controls also include start switch 192, stop switch 194, blasting on/off switch 196, fast/slow switch 198, door limit switches 200 and 202, and cylinder stroke limit switch 204. Fast/slow switch 198 is used to control the speed of and air pressure supplied to nozzle 108. The slow setting is used with sandpaper of eighty grit or coarser, or for sandpaper having a particularly heavy buildup. At this slow setting, nozzle 108 traverses the width of the belt more slowly while the higher air pressure provides a greater volume of particulate for each unit of time, i.e., a higher "pellet count." In this way, a greater cleaning action is achieved. For sandpaper of fine grit, the fast setting switch 190 is preferred.

Door limits 200 and 202 respectively engage housing doors 32 and 46 in order to allow sandblasting operation only when these doors are closed. In another preferred embodiment, a single door limit switch can be used by mounting it at the corner junction between doors 32 and 46 so that this single limit switch must be engaged by both doors before operation is allowed.

Cylinder limit switch 204 is mounted above rack 164 and is engaged by the end of the rack as it moves upwardly. When so engaged, the action on cylinder 160 is reversed. In order to control the stroke of rack 164, and thereby control the incremental movement of drum 58, cylinder 160 is bolted through slots so that it can be shifted axially. By shifting cylinder 160 upwardly, rack 164 moves a shorter distance before engaging limit switch 161 and in this way drum 58 rotates through a smaller arc. Conversely, by shifting cylinder 160 downwardly, rack 164 moves a longer distance and drum 58 rotates through a larger arc.

During operation, when wheel 134 engages one of limit switches 152, 154, cylinder 160 is activated to shift drum 58 and the direction of carriage 126 is reversed. When drum 58 is shifted, a new portion of belt 190 is presented for cleaning.

A number of particulates may be used for sandpaper cleaning purposes. For example, ground walnut shells can be used, although the oil content of these shells can be a problem. Better results have been obtained when using glass beads such as GB-04-K soda lime glass beads available from the Surface Finishing Company of Kansas City, Kans.

We claim:

1. An article of manufacture for cleaning sandpaper comprising:

means for supporting sandpaper in a cleaning position, the sandpaper presenting a sanding surface and being subject to accumulation of sanded material thereon;

blasting means for creating a stream of particulates directed toward a portion of the sanding surface for dislodging sanded material therefrom; and positioning means including:

means for selectively altering the relative material orientation of said blasting means and said sanding surface, for selectively directing said stream toward specific portions of said sanding surface, and means for incrementally shifting said sanding surface in order to present said respective sanding surface portions to said blasting means.

2. Apparatus as set forth in claim 1, including shifting means operably coupled with said blasting means for selective relative movement between said blasting means and said sanding surface.

3. Apparatus as set forth in claim 2, said blasting means including a nozzle, there being conduit means operably coupling said nozzle with a supply of said particulates, said shifting means including structure for selective translatory movement of said nozzle relative to said sanding surface.

4. Apparatus as set forth in claim 3, said structure being operable for reciprocal side-to-side movement of said nozzle, there being limit switch means for defining the limits of said side-to-side movement.

5. Apparatus as set forth in claim 1, said positioning means including apparatus for selective movement of said sandpaper in order to present respective portions of said sanding surface to said blasting means for cleaning of the respective portions.

6. Apparatus as set forth in claim 5, said sandpaper-moving apparatus including an elongated drum adapted to receive said sandpaper, and means for axially and incrementally shifting said drum in order to present said respective sanding surface portions to said blasting means.

7. Apparatus as set forth in claim 6, including hold-down means for pressing said sandpaper against said drum.

8. Apparatus as set forth in claim 1, including means for collecting material cleaned from said sandpaper.

9. Apparatus as set forth in claim 8, said material-collecting means including a material port, and means for creating a vacuum within said port for removal and collection of said cleaned material.

10. Apparatus as set forth in claim 1, including structure defining a hopper for said particulates, there being a conduit operably interconnected between said nozzle and hopper for conveyance of said particulates from the hopper to the nozzle.

11. Apparatus as set forth in claim 10, said hopper being located beneath said blasting means for collection of particulates after impingement thereof on said sanding surface, whereby said particulates may recirculated to said nozzle.

12. Apparatus as set forth in claim 1, said sandpaper being in the form of an endless belt including a flexible substrate and grit applied to the outer surface of said substrate to define said sanding surface, said sandpaper-supporting means including an elongated drum adapted to receive said endless belt thereover.

13. Apparatus as set forth in claim 12, said substrate being paper.

14. Apparatus as set forth in claim 12, said substrate being cloth.

15. Apparatus as set forth in claim 1, said particulates being selected from the group consisting of ground walnut shells and glass beads.

16. Apparatus as set forth in claim 1, including a housing enclosing said sandpaper supporting means and blasting means, said housing including an openable door for placement and removal of sandpaper.

17. A method of cleaning sandpaper presenting a sanding surface subject to accumulation of sanded material thereon, said method comprising the steps of:

placing said sanding surface in a cleaning position;

creating a stream of particulates for dislodging said sanded material from said sanding surface;

directing said stream for impingement of said particulates against said sanding surface in order to clean said material therefrom; and incrementally shifting said sandpaper to present specific portions of said sanding surface to said stream.

18. The method as set forth in claim 17, including the step of causing relative movement between said stream and sanding surface for sequentially cleaning different portions of said sanding surface.

19. The method as set forth in claim 18, including the step of moving said stream from side-to-side between the side margins of said sandpaper surface.

20. The method as set forth in claim 18, including the step of incrementally shifting said sandpaper to present said different portions of said sanding surface.

21. The method as set forth in claim 17, including the step of collecting said sanded material after dislodgement thereof from said sanding surface.

22. The method as set forth in claim 17, including the step of accumulating said particulates after impingement thereof upon said sanding surface, and reusing said accumulated particulates in said stream.

23. An article of manufacture for cleaning sandpaper comprising:

means for supporting sandpaper in a cleaning position, the sandpaper presenting a sanding surface and being subject to accumulation of sanded material thereon;

blasting means for creating a stream of particulates directed toward a portion of the sanding surface for dislodging sanded material therefrom; and positioning means for selectively altering the relative spatial orientatiom of said blasting means and said sanding surface, for selectively directing said stream toward different portions of said sanding surface, in order to clean the entire sanding surface, said positioning means including apparatus for selective movement of said sandpaper in order to present respective portions of said sanding surface to said blasting means for cleaning of the respective portions, said sandpaper-moving apparatus including an elongated drum adapted to receive said sandpaper, and means for axially and incrementally shifting said drum in order to present said respective sanding surface portions to said blasting means.

24. Apparatus as set forth in claim 23, including hold-down means for pressing said sandpaper against said drum.

* * * * *